United States Patent [19]

Pugh et al.

[11] Patent Number: 4,964,566

[45] Date of Patent: Oct. 23, 1990

[54] FORCED AIR VENTILATING DEVICE

[75] Inventors: J. Robert Pugh, Greensboro; James F. Matherly, Summerfield, both of N.C.

[73] Assignee: Custom Industries, Inc., Greensboro, N.C.

[21] Appl. No.: 390,651

[22] Filed: Aug. 7, 1989

Related U.S. Application Data

[62] Division of Ser. No. 258,315, Oct. 14, 1988, Pat. No. 4,877,182.

[51] Int. Cl.[5] ..... F24F 13/12

[52] U.S. Cl. ..... 236/49.3; 98/41.3; 137/625.33

[58] Field of Search ..... 236/49.3, 49.5, 75; 98/29, 41.3, 116; 137/625.33, 625.28; 251/129.15

[56] References Cited

U.S. PATENT DOCUMENTS

| | | | |
|---|---|---|---|
| 328,156 | 10/1885 | Tucker | 236/49.3 |
| 957,776 | 5/1910 | Ilg | 98/116 X |
| 3,073,525 | 1/1963 | Cislo | 98/41.3 X |
| 3,363,536 | 1/1968 | Dean, Jr. | 98/41.3 |
| 3,645,108 | 2/1972 | Houk | 236/49.5 X |
| 3,948,154 | 4/1976 | Asakai et al. | 236/49.3 X |
| 4,178,841 | 12/1979 | Frank et al. | 98/98 |
| 4,407,187 | 10/1983 | Horney | 98/41 |
| 4,715,532 | 12/1987 | Sarazen et al. | 236/49 |
| 4,781,220 | 11/1988 | Smith | 137/625.33 X |

*Primary Examiner*—William E. Tapolcai

*Attorney, Agent, or Firm*—Rhodes, Coats & Bennett

[57] ABSTRACT

An automatically controlled forced air ventilating device for installation in a structural wall and used in controlling the movement of air into and out of a prescribed area. A ventilator apparatus for the device includes a first stationary plate and a second movable plate, each of the plates including apertures therein and a control means for moving the second plate between first and second positions in which the apertures are aligned and not aligned. A fan is attached to the ventilator apparatus for moving air therethrough at times when the second plate is in the second position with the apertures aligned. A sensing means senses prescribed conditions of air and activates the fan and the control means responsive thereto when prescribed levels of air conditions have been exceeded.

5 Claims, 3 Drawing Sheets

FORCED AIR VENTILATING DEVICE

This application is a division of application Ser. No. 258,315, filed 10/14/88, now U.S. Pat. No. 4,877,182.

BACKGROUND AND SUMMARY OF THE PRESENT INVENTION

The present invention is related to an automatically controlled ventilation system for providing a forced air exchange in the dead air spaces of a structure. Although such dead air spaces can exist in a variety of areas, the present system is particularly suited for use in the crawl space beneath a house or other structure where the building foundation raises the sub-floor above the ground.

Lack of sufficient ventilation and movement of air in such crawl spaces results in a build-up of excess moisture and also a build-up of Radon gases. Failure to dissipate such build-up leads to undesirable conditions such as pest problems, fungal growth, sweating and resultant damage to floor trusses and other structural components. Further, the humidity can invade the interior areas of the house, causing structural damage and/or growth of fungi or molds in the house. Heating and air conditioning loads are also increased by excess humidity levels.

Previous approaches to the control or elimination of such problems have been primarily related to installation of foundation ventilators, some of which open or close responsive to the temperature of outside air. Other approaches include the application of layers of polymeric materials over the earth within the crawl space. However, these materials do not inhibit the spread of moisture within the underlying dirt, and do not eliminate the problem. These layers of polymeric materials generally only delay humidity damage. Further, there is no effect on moisture which enters through open ventilators.

Regarding specific ventilator problems, most foundation-type ventilators are of the wire screen or mesh type and are closed either by the placing of a solid shield over the face of the ventilator, or by a shutter hingedly connected to the rear of the vent screen and pulled closed by means of a rod which extends outwardly from the shutter. Such structure is prone to failure because the screens puncture, the shutters fail to close, or do not close tightly, as a few examples only.

The present invention eliminates the above problems by provision of a unique forced air ventilation system and an improved ventilator. The air flow system itself includes an intake unit and an exhaust unit. The ventilator structure is of an improved sliding-plate-type having a solenoid control for opening and closing the sliding plate.

The intake unit of the ventilation system includes an intake ventilator positioned at a selected location in the foundation, and a temperature sensing device for sensing the temperature of the outside air. For example, it is undesirable to have the ventilator open when outside air is at sub-freezing levels because the admission of sub-freezing air can cause pipes to freeze and also increase the load on the furnace or other heating system. In the present system, when air temperature drops below freezing, the thermostatic control activates the solenoid to close the vent(s).

The exhaust unit also includes at least one solenoid-operated ventilator, a fan, and a humidity-sensing device. The humidistat is set to a predetermined humidity level and positioned in the area subject to the greatest humidity. When the humidity in this area rises above the prescribed level, the humidistat closes an electrical circuit, sending power to the thermostat. If, however, the outside temperature is below freezing, the thermostat will have relayed the signal, closing down the system, and the exhaust fans will not operate. Both the thermostat and the humidistat can be set to any desired level according to prevailing climatic needs. As stated above, the primary function of the thermostat is to prevent the introduction of sub-freezing air into the structural foundation. Thus, if the outside temperature is above freezing when the humidistat relays a signal to the thermostat, the thermostat will close the circuit and send power to the solenoid and the exhaust fan.

One advantage found is that the present invention permits the reduction of the number of ventilators necessary in a foundation wall because of the moving air. Therefore, there is less opportunity for cold air and moisture to enter the crawl space.

It was therefore an object of the present invention to provide an automatic system for ventilating the dead air spaces within a structure. It was a further objective to provide a ventilation system for crawl spaces, which system would function automatically, responsive both to humidity levels within the crawl space and to outside temperature.

Other and further objects will become apparent as the following detailed description is studied in conjunction with the following drawings.

DETAILED DESCRIPTION OF PREFERRED EMBODIMENT

Figure 1:
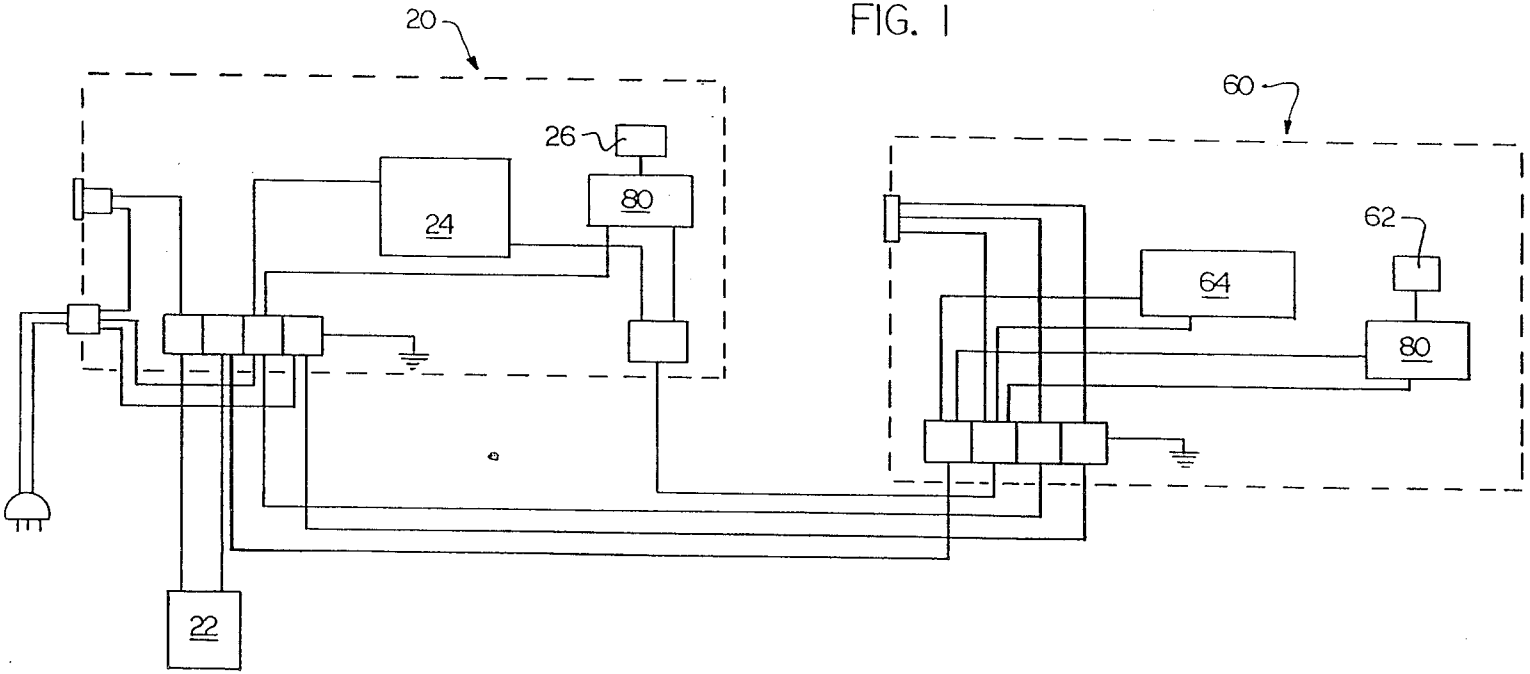
FIG. 1 is a schematic diagram of the ventilating system according to a preferred embodiment.
Figure 2:
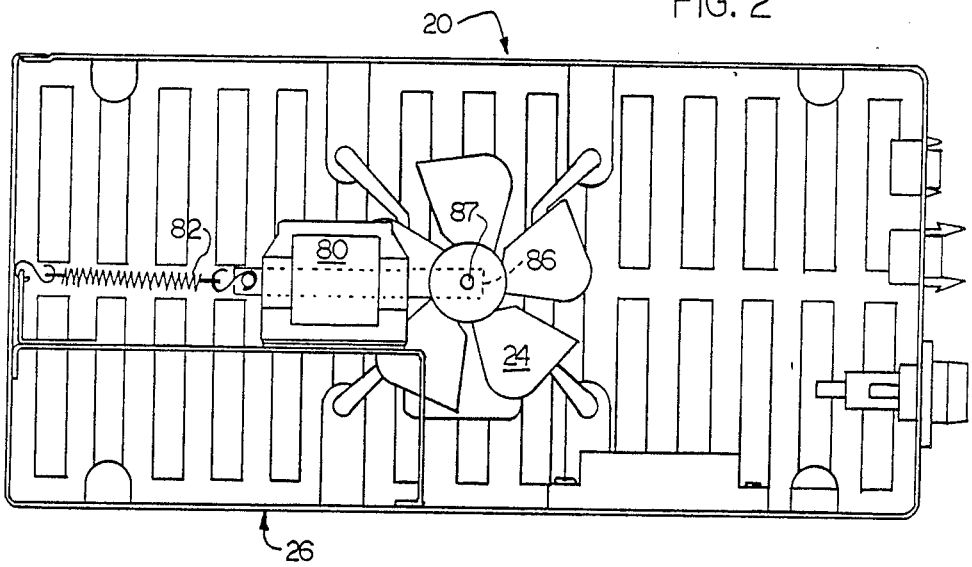
FIG. 2 is an elevation view, taken from the rear, of the exhaust apparatus.
Figure 3:
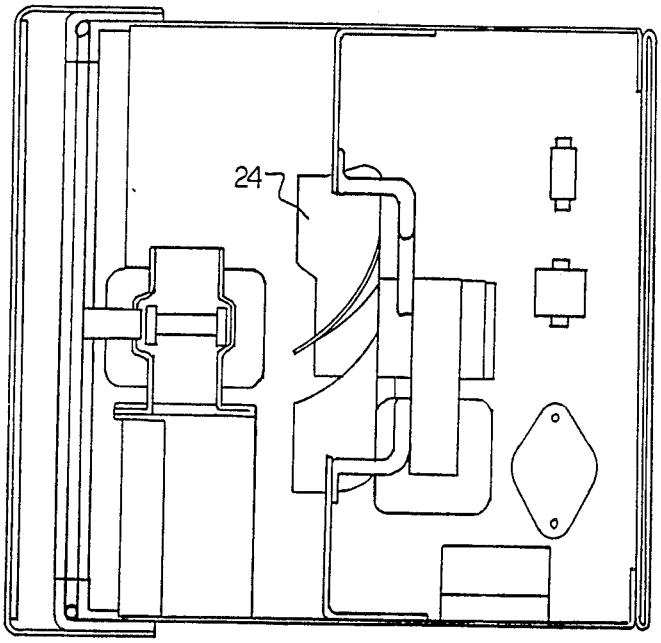
FIG. 3 is a side elevation of the exhaust apparatus of FIG. 2.
Figure 6:
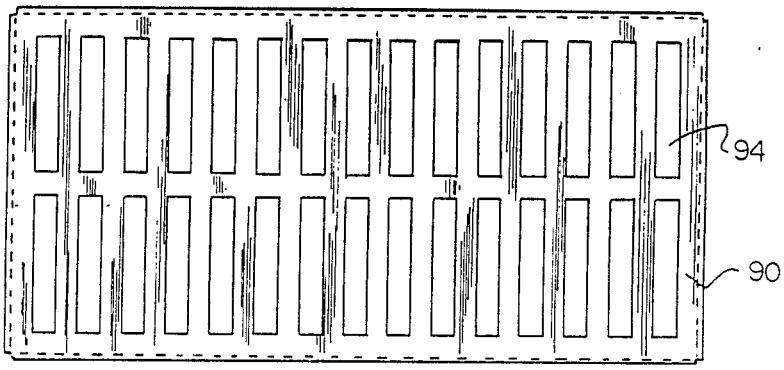
FIG. 6 is a plan view of the front or outwardly facing, stationary ventilator plate.
Figure 5:
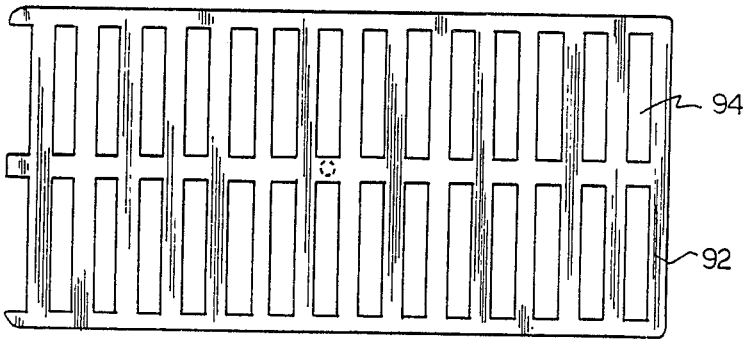
FIG. 5 is a plan view of the forward face of the rear, sliding venti-lator plate.
Figure 4:
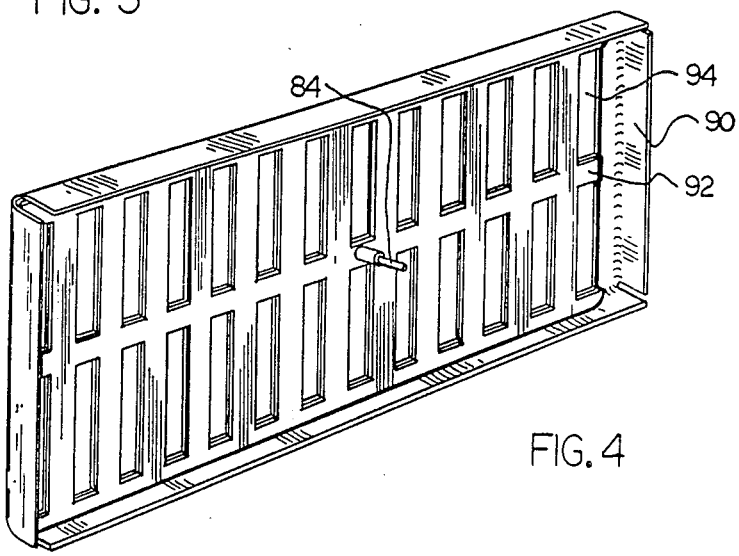
FIG. 4 is a rear perspective view of the ventilator utilized in the intake and exhaust systems, according to a preferred embodiment.

Looking first at the FIG. 1 schematic, there are two major units in the ventilation system of the present invention, the exhaust unit 20 and the intake unit 60. The exhaust unit 20 primarily functions to remove humid, stale air from the prescribed space and includes: a humidity sensing device 22, a fan 24 for pulling stale air out, and an exhaust ventilator 26. The intake unit 60 functions to draw in fresh, outside air and generally includes: an intake ventilator 62 positioned in the foundation outside wall, and a temperature sensing device 64 for sensing the temperature of the outside air. All ventilators, both intake and exhaust are controlled by solenoids 80.

As stated above in the summary, each of the intake and exhaust unit 20, 60 may include multiple ventilators 26, 62 dependent on the size of the area being ventilated. It is generally preferred to have at least 2½to 3 exchanges of air per hour. However, while it is important that the exchange of air be at a level sufficient to dehumidify the crawl space, it is equally important that this be accomplished with a relatively low CFM of air movement in order to avoid creating a negative air pressure or draft situation. The creation of such drafts can interfere with pilot lights on furnace and/or hot water systems.

As illustrated, in FIG. 1, the system functions responsive to levels of both humidity and temperature of outside air. At ambient temperatures above freezing, the humidistat 22 controls operation. At temperatures below freezing, the thermostat 64 controls by cutting off the main power source. When this occurs, the circuit is closed to the solenoids, causing the intake and exhaust ventilators to close.

When temperatures are above freezing, and when the humidity in a prescribed area rises above a predetermined level, the humidistat 22 sends a signal to close the circuits to the solenoids, causing the vents to open, and also to the exhaust fan, causing the fan to cut on to pull the stale air out..

All ventilators 26 and 62 are opened and closed by a solenoid-controlled spring 82. Extension spring 82 is mounted between the the solenoid 80 and a rearwardly extending push pin 84 attached to the rear face of the ventilator slide plate. The ventilators are each comprised of an outwardly disposed stationary plate 90, and a second, slidingly movable closure plate 92 mounted behind the stationary plate. Each of the plates 90, 92 include a plurality of vertically disposed elongated slots 94 therethrough. When the plates 90, 92 are continguously positioned, the slots in plate 90 are out of alignment with the slots in plate 92 and the ventilator is thereby closed. No air moves therethrough. To open, solenoid 80 is activated to overcome compression spring 82, causing the second plate 92 to move laterally, sliding out of alignment with first plate 90, whereby the slots in each plate are aligned with each other, permitting air to flow through the ventilator.

As previously stated, the solenoid 80 is connected to push pin 84 on plate 92. The operative connection which causes the plate to slide is a solenoid plunger 86. One end of solenoid plunger 86 is operatively connected to the electrically energized coil within the solenoid. The opposite end of the plunger is included on aperture 87 through which the push pin 84 is mounted. When the coil in the solenoid is energized, the plunger is laterally displaced and pulls or pushes the sliding plate 92 into position to open or close the ventilator. A stop means within the solenoid controls the degree of plunger movement in one direction.

The intake and exhaust ventilators 62 and 26 are positioned within the exterior foundation walls at locations selected according to the desired air flow pattern. For example, the exhaust ventilator 26 should be positioned near or adjacent the areas of dampness or moisture collection. The exhaust fans associated with the exhaust ventilators are conventional, shelf-model exhaust fans chosen according to the size required to achieve the desired CFM movement.

The thermostat and humidistat are also conventional models selected according to specific installation requirements. Other and further modifications are also possible while remaining within the scope of the claims below.

What is claimed is:

1. A forced air ventilating device for installation in a structural wall and for use in controlling the movement of air into and out of a prescribed area, said forced air ventilating device comprising:

(a) a ventilator apparatus including:

(i) a first stationary plate means having substantially planar front and rear faces and a plurality of apertures therethrough according to a prescribed pattern, (ii) a second, movable plate means having substantially planar front and rear faces, a plurality of apertures therethrough and mounted adjacent said rear face of said stationary plate, said second plate being slidingly movable between a first position in which said plurality of apertures in said second plate are out of alignment with apertures in said first plate, and a second position wherein said apertures are aligned with the apertures in said first plate;

(iii) control means for automatically moving said second plate between said first and second positions, wherein said control means is a solenoid having a linkage means operatively connecting said solenoid to said second plate, said solenoid being activated responsive to a thermostat positioned to measure temperature outside the space being ventilated, wherein said linkage means includes:

(a) bias means connected to said linkage means for normally biasing said second plate in said first position;

(b) said linkage means connecting said second plate to said solenoid such that when said solenoid is activated, said bias means is overridden and said second plate is slidingly moved to said second position;

(b) a fan means attached to said ventilator apparatus for moving air therethrough at times when said second plated is in said second position;

(c) sensing means for sensing prescribed conditions of air at at least one selected point; and (d) electrical means for activating said fan and said control means responsive to a signal from said sensing means that prescribed levels of air conditions have been exceeded.

2. The forced air ventilating device according to claim 1 further including said apertures in said plates being in the shape of elongated, vertically extending and positioned in horizontally spaced relationship across the widths of said first and second plates.

3. The forced air ventilating device according to claim 1 wherein said bias means is an elongated compression spring.

4. The forced air ventilating device according to claim 1 wherein said means for connecting said second plate to said solenoid includes:

(a) a push pin extending perpendicularly from the rear face of said second plate;

(b) said solenoid having a plunger movable in a lateral direction responsively to said solenoid being energized; said plunger being connected to said pin on said second plate, such that when said solenoid is energized said plunger reciprocates and causes said second plate to move between said first and second positions.

5. The forced air ventilating device according to claim 1 wherein said sensing means is a humidistat.

* * * * *